US008540519B1

(12) United States Patent
Lauter

(10) Patent No.: US 8,540,519 B1
(45) Date of Patent: Sep. 24, 2013

(54) SEATED BALANCING DEVICE

(76) Inventor: James Lauter, Steamboat Springs, CO (US)

( * ) Notice: Subject to any disclaimer, the term of this patent is extended or adjusted under 35 U.S.C. 154(b) by 338 days.

(21) Appl. No.: 12/961,381

(22) Filed: Dec. 6, 2010

Related U.S. Application Data

(60) Provisional application No. 61/405,641, filed on Oct. 21, 2010.

(51) Int. Cl.
*A63B 69/00* (2006.01)

(52) U.S. Cl.
USPC ..... 434/247

(58) Field of Classification Search
USPC ..... 434/247
See application file for complete search history.

(56) References Cited

U.S. PATENT DOCUMENTS

| | | | | | |
|---|---|---|---|---|---|
| 2,374,350 | A | * | 4/1945 | Herold | 297/300.7 |
| 2,818,911 | A | * | 1/1958 | Syak | 248/575 |
| 3,220,688 | A | * | 11/1965 | Baermann | 248/596 |
| 3,672,075 | A | | 6/1972 | Eikelenboom | |
| 3,863,982 | A | * | 2/1975 | Sandham | 297/302.5 |
| 3,997,979 | A | | 12/1976 | Turner | |
| 4,509,743 | A | | 4/1985 | Lie | |
| 4,575,072 | A | | 3/1986 | Russell | |
| 4,597,567 | A | * | 7/1986 | Racca | 267/140.2 |
| 4,741,550 | A | | 5/1988 | Dennis | |
| 4,743,019 | A | | 5/1988 | Lequeux | |
| 4,759,542 | A | | 7/1988 | Hudec | |
| 4,801,140 | A | | 1/1989 | Bergeron | |
| 4,860,987 | A | * | 8/1989 | Werner | 248/405 |
| 4,871,208 | A | * | 10/1989 | Hodgdon | 297/303.1 |
| 5,092,586 | A | | 3/1992 | Tuthill | |
| 5,577,811 | A | * | 11/1996 | Ogg | 297/452.15 |
| 5,603,334 | A | | 2/1997 | Sharp | |
| 5,613,690 | A | | 3/1997 | McShane | |
| 6,019,712 | A | | 2/2000 | Duncan | |
| 6,209,958 | B1 | * | 4/2001 | Thole | 297/302.1 |
| 6,210,286 | B1 | | 4/2001 | Ohara | |
| 6,481,795 | B1 | * | 11/2002 | Pettibon | 297/314 |
| 6,599,198 | B2 | | 7/2003 | Ettenhofer | |
| 6,666,802 | B1 | | 12/2003 | Rasmussen | |
| 6,709,052 | B2 | | 3/2004 | Jalkanen | |
| 6,752,452 | B2 | * | 6/2004 | Choi et al. | 297/16.2 |
| 7,008,360 | B1 | | 3/2006 | Smith | |
| 7,070,415 | B2 | | 7/2006 | Hojo | |
| 7,081,075 | B2 | | 7/2006 | Sachs | |
| 7,201,709 | B1 | | 4/2007 | Pebbles, Jr. | |
| 7,300,392 | B1 | | 11/2007 | Curran | |
| 7,335,172 | B2 | | 2/2008 | Laserow | |
| 7,347,806 | B2 | | 3/2008 | Nakano | |
| 7,357,766 | B2 | | 4/2008 | Langer | |
| 7,374,517 | B2 | * | 5/2008 | Lockett | 482/131 |
| 7,465,253 | B2 | | 12/2008 | Perry | |

(Continued)

*Primary Examiner* — Kurt Fernstrom
*Assistant Examiner* — Dolores Collins
(74) *Attorney, Agent, or Firm* — Albert Haegele; Leyendecker & Lemire, LLC

(57) ABSTRACT

A device for developing and improving seated balance is described. The device can be used to develop seated balance that is beneficial for horseback riding, kayaking, and other sports where seated balance is required. Embodiments include a seated balancing device that includes a seat borne by a universal joint, the universal joint being borne by a support member. The universal joint provides a pivot point, and a seating surface resides within 7 inches of the pivot point. The universal joint enables the seat to have at least two rotational degrees of freedom, which permits the seat to tilt in multiple directions.

16 Claims, 5 Drawing Sheets

(56) References Cited

U.S. PATENT DOCUMENTS

| | | | | |
|---|---|---|---|---|
| 7,476,188 | B2 | 1/2009 | Perez, Jr. | |
| 7,553,261 | B2 | 6/2009 | Carbone | |
| 7,806,479 | B2 * | 10/2010 | Jensen et al. | 297/303.1 |
| 7,833,129 | B2 * | 11/2010 | Badarneh et al. | 482/5 |
| 7,927,258 | B2 * | 4/2011 | Irving et al. | 482/57 |
| 8,075,453 | B1 * | 12/2011 | Wilkinson | 482/51 |
| 8,092,352 | B2 * | 1/2012 | Irving et al. | 482/57 |
| 8,286,531 | B2 * | 10/2012 | Jones et al. | 74/572.4 |
| 8,298,845 | B2 * | 10/2012 | Childress | 438/47 |
| 2002/0140259 | A1 | 10/2002 | Wiegand | |
| 2003/0109365 | A1 | 6/2003 | Smith | |
| 2006/0287173 | A1 | 12/2006 | Guadagno | |
| 2007/0138850 | A1 | 6/2007 | Oettinger | |
| 2007/0298395 | A1 | 12/2007 | Nakanishi | |
| 2007/0298947 | A1 | 12/2007 | Eksteen | |
| 2008/0009395 | A1 | 1/2008 | Tseng | |
| 2008/0039291 | A1 | 2/2008 | Latella | |
| 2009/0011393 | A1 * | 1/2009 | Lin | 434/247 |
| 2009/0062090 | A1 | 3/2009 | Nakanishi | |
| 2010/0087761 | A1 * | 4/2010 | Hitzmann | 601/52 |
| 2011/0087137 | A1 * | 4/2011 | Hanoun | 600/587 |
| 2011/0275939 | A1 * | 11/2011 | Walsh et al. | 600/473 |

* cited by examiner

SEATED BALANCING DEVICE

This application claims priority to, and incorporates by reference, U.S. provisional patent application No. 61/405,641, filed on 21 Oct. 2010 and having the same title and inventor as the present application.

FIELD OF THE INVENTION

The present invention relates generally to devices for developing balance and coordination while seated.

BACKGROUND

In order to become a skilled rider, a horseback rider usually develops a good sense of balance while seated. The rider must become adept at remaining balanced atop a horse as the horse moves beneath the rider.

Good seated balance benefits both the rider and the horse. When the rider is well balanced, she is better able to stay in control on the horse, and the horse is better able to move beneath the rider. This is particularly important where the horse is performing demanding tasks such as jumping, quickly accelerating or decelerating, running at high speed, or changing direction suddenly.

Kayaking is also an activity that requires seated balance, as a kayaker must remain balanced with her center of mass typically positioned above a kayak as the boat pitches, rolls, yaws, changes direction, and accelerates/decelerates beneath her.

Most devices for developing balance are adapted for use while the user is supported by his or her limbs. For instance, devices and exercises where a user stands on an unstable surface, often on only one foot, are well known. Such devices do little for seated balance.

Exercise balls are devices adapted to seated balance training A user can sit on the exercise ball and lift her feet from the ground, thereby requiring the user to balance on the ball in a seated position. However, it is difficult to limit range of motion on an exercise ball, and the balls typically have three translational, as well as rotational, degrees of freedom; they usually roll across a support surface when the user loses her balance. The property of rolling makes the exercise ball ill suited for a seated balance training device for horseback riding.

Moreover, an exercise ball is typically 45 cm or greater in diameter, which places the user relatively high above a point about which the user rotates as the ball rolls. Conversely, a kayak typically rotates about a point just beneath a kayaker as the kayak pitches, rolls, and yaws in water. Accordingly, balancing on exercise balls is relatively poor seated balance training for kayaking.

DETAILED DESCRIPTION

Figure 1:
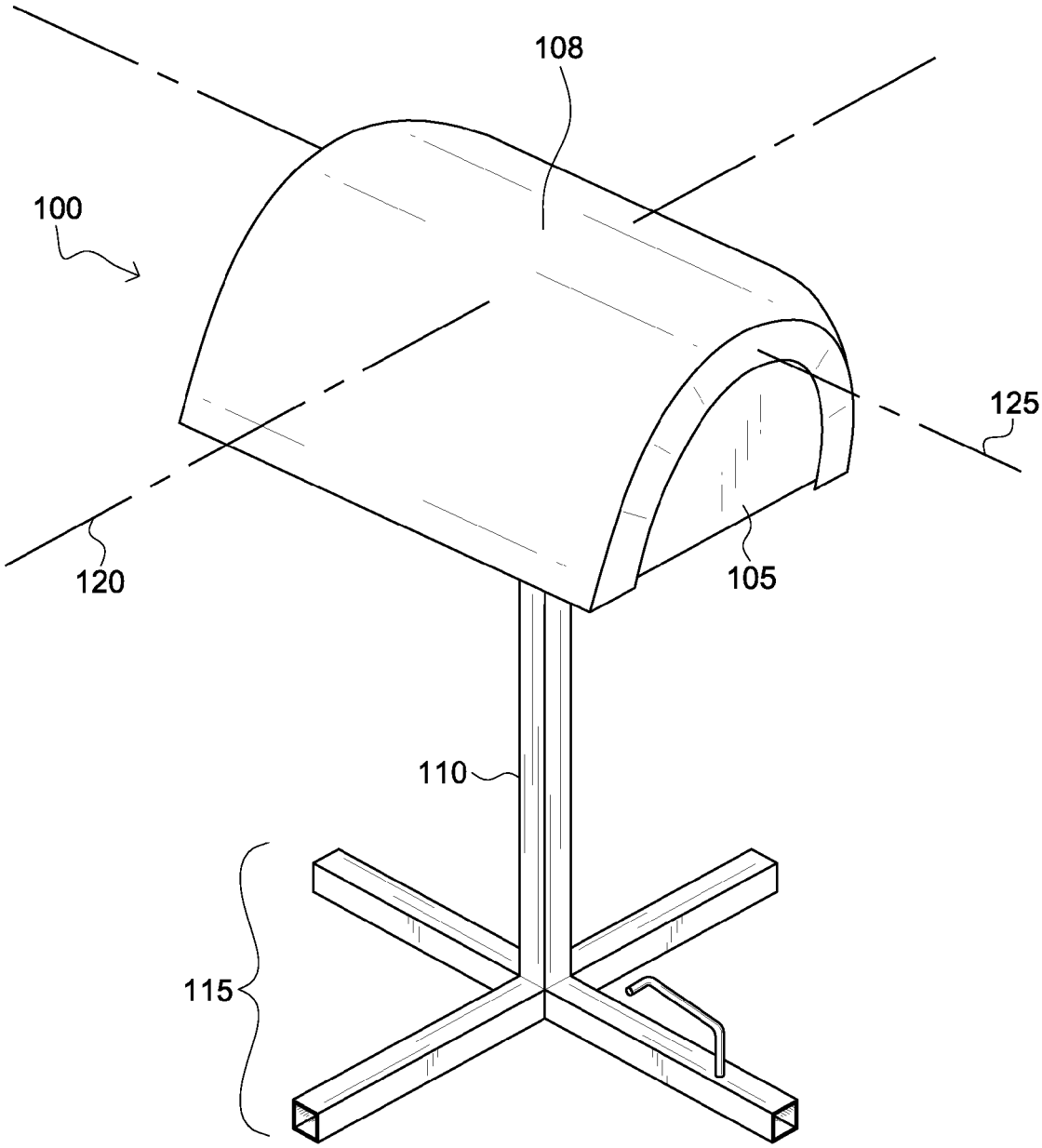
FIG. 1 is a perspective view of a seated balancing device according to one embodiment of the present invention.

Embodiments of the present invention comprise a seated balancing device that includes a seat disposed on a universal joint having at least two rotational degrees of freedom. The universal joint is typically born on a support member, and a seat is borne on the universal joint. A seating surface of the seat typically, but not necessarily, resides at a height of about 22 inches to about 40 inches above the ground or other support surface. In some embodiments, the seating surface resides about 22 inches to about 40 inches above a step or similar foot support. Because a desirable height of the seat varies with height of the user, seat height is typically adjustable.

In some embodiments, the seating surface resides within 12 inches of the ground, and the seated balancing device is adapted for use with the user's legs projecting out in front of the seat in a manner similar to a kayaker seated in a kayak. Embodiments include an actual kayak or reasonable facsimile thereof borne atop the universal joint, the seating surface residing within the kayak. Where a seated balancing device is used in kayak mode, the user may use a kayak paddle or rod about as long as a kayak paddle to press against the ground or otherwise aid in seated balancing.

In some embodiments, the seat is a straddle seat having a seating surface that is upwardly convex along a lateral or transverse axis, the seating surface being adapted to comfortably support a user who straddles the seat. Optimally, the straddle seat resides at a height such that a user who straddles the seat while sitting thereupon is able to touch the ground or foot support with her toes or balls of feet, but not with her heels, while extending her legs with knees straight or almost straight. The user then raises her toes while flexing her knees slightly, whereupon the user's feet no longer touch the ground or foot support, and therefore no longer stabilize her in the straddle seat, which is relatively free to tilt about a pivot point of the universal joint.

Embodiments of the seated balancing device include adjustable resistance to tilting about the pivot point, such that a user can increase resistance to tilting and therefore make balancing on the seated balancing device easier. Similarly, embodiments of the seated balancing device include means for limiting the seat or the universal joint's range of motion. As the user's balance improves, the user can decrease the resistance or increase the range of motion of the universal joint, and thereby increase challenge to seated balance presented by the device. In some embodiments, the resistance to tilting or range of motion of the universal joint is not adjustable. Typically, but not necessarily, the range of motion of the seat is adjusted by modulating tilting range of the universal joint, which is adjustable.

Embodiments of the seated balancing device further comprise a hand hold that provides a stable structure within reach of a user seated on the seat. The hand hold provides a means by which the user can stabilize herself while sitting in the seat, without touching the ground or foot support with her foot or feet.

The seated balancing device typically does not possess substantial self-righting capability. Accordingly, the device does not provide substantial assistance in returning the seat of the device to a neutral position. Similarly, the device is not powered; seat movement is caused or affected by gravity and a seated user's movement and center of mass, but not by a motor.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "seat," as used in this specification and appended claims, refers to a structure designed and adapted to support a person in an upright, sitting position. Accordingly, a seat is adapted to receive human buttocks and support the weight of a person sitting upright thereupon. A "seating surface" of a seat is an upper surface of the seat that is or is designed to be in contact with and directly beneath a person sitting upright on the seat.

The term "straddle seat," as used in this specification and appended claims, refers to a seat designed and adapted to be straddled by a person seated upright on the straddle seat. A straddle seat has a seating surface that is upwardly convex along a transverse (lateral) axis. A seat having a semi-cylindrical form with its convex surface oriented upwardly to form a seating surface is an archetypical straddle seat. Both English and Western style horseback riding saddles are examples of straddle seats. The convex seating surface of a straddle seat is typically designed and adapted to receive the buttocks or inside thighs of a person seated thereupon.

The term "universal joint," as used in this specification and appended claims, refers to a structural assembly familiar to persons skilled in the art, comprising first and second bodies, wherein at least two rotational degrees of freedom are allowed between the two bodies. As used herein, a universal joint permits the first body to rotate about a first axis and to rotate about a second axis, while the second body remains static. The first axis is perpendicular to the second axis. In some universal joints, the first axis and the second axis both reside in the same plane. All three translational degrees of freedom of the first and second bodies can remain fixed during rotation of the first body about the first axis or the second axis. Where exactly two rotational degrees of freedom are allowed between the two bodies, the universal joint can be referred to as having two rotational degrees of freedom. Where exactly three rotational degrees of freedom are allowed between the two bodies, the universal joint is referred to as having three rotational degrees of freedom. In some embodiments, a seat of the seated balancing device is affixed to and moves with the first body, and the second body is affixed to a support member of the seated balancing device. Rotation of the first body or the seat attached thereto about any horizontal axis is referred to as tilt. In some embodiments, the universal joint may also allow the seat to rotate about a vertical axis. The rotation about a vertical access may be referred to as "yaw."

The term "pivot point," as used in this specification and appended claims, refers to a point where the first axis of a universal joint intersects the second axis of the universal joint, except in embodiments where the first and second axes do not intersect. In universal joints where the first and second axes do not intersect (i.e. they do not both reside in the same plane) a pivot point resides equidistant between the first axis and the second axis where the first and second axes are closest to each other.

The terms "tilt range" or "range of motion," as used in this specification and appended claims, refer to a range of rotation of a first body of a universal joint or seat attached thereto, between two limits, about a horizontal axes. Tilt range or range of motion is typically expressed in degrees.

The term "neutral position," as used in this specification and appended claims, refers to a position of a seat of a seated balancing device, where a center of mass of the seat resides along a straight vertical line that intersects a pivot point of the seated balancing device, or is tilted 3° or less from the straight vertical line. In other words, the seat is in a neutral position when an axis that extends from a center of mass of the seat through the pivot point is within 3° of vertical. Where a user is seated in the seat, a center of mass of the seated rider is the relevant center of mass for determining a neutral position.

The term "motor," as used in this specification and appended claims, refers to a device for converting potential energy such as electrical or chemical energy into mechanical energy. Accordingly, a motor used to move a seat of the seated balancing device, or for storing mechanical energy that is subsequently use to move the seat. Examples of motors include, but are not limited to, electric motors, internal combustion engines, friction motors, and flywheels.

The term "self-righting," as used in this specification and appended claims, refers to a tendency of a seat of a seated balancing device to move to one particular position, the one particular position not residing at a range of motion limit. The one particular position is typically, but not necessarily, a neutral position. A seat is substantially self-righting if the seat will spontaneously move from a different position to the one particular position with a mass of 4 kg or more residing on the seating surface of the seat.

The term "sitting upright," as used in this specification and appended claims, refers to a sitting position assumed by a person, in which the person's weight resides substantially on his or her buttocks, insides of thighs, or backs of thighs, with the person's spine being within 45° of vertical.

A First Embodiment Seated Balancing Device

Figure 2:
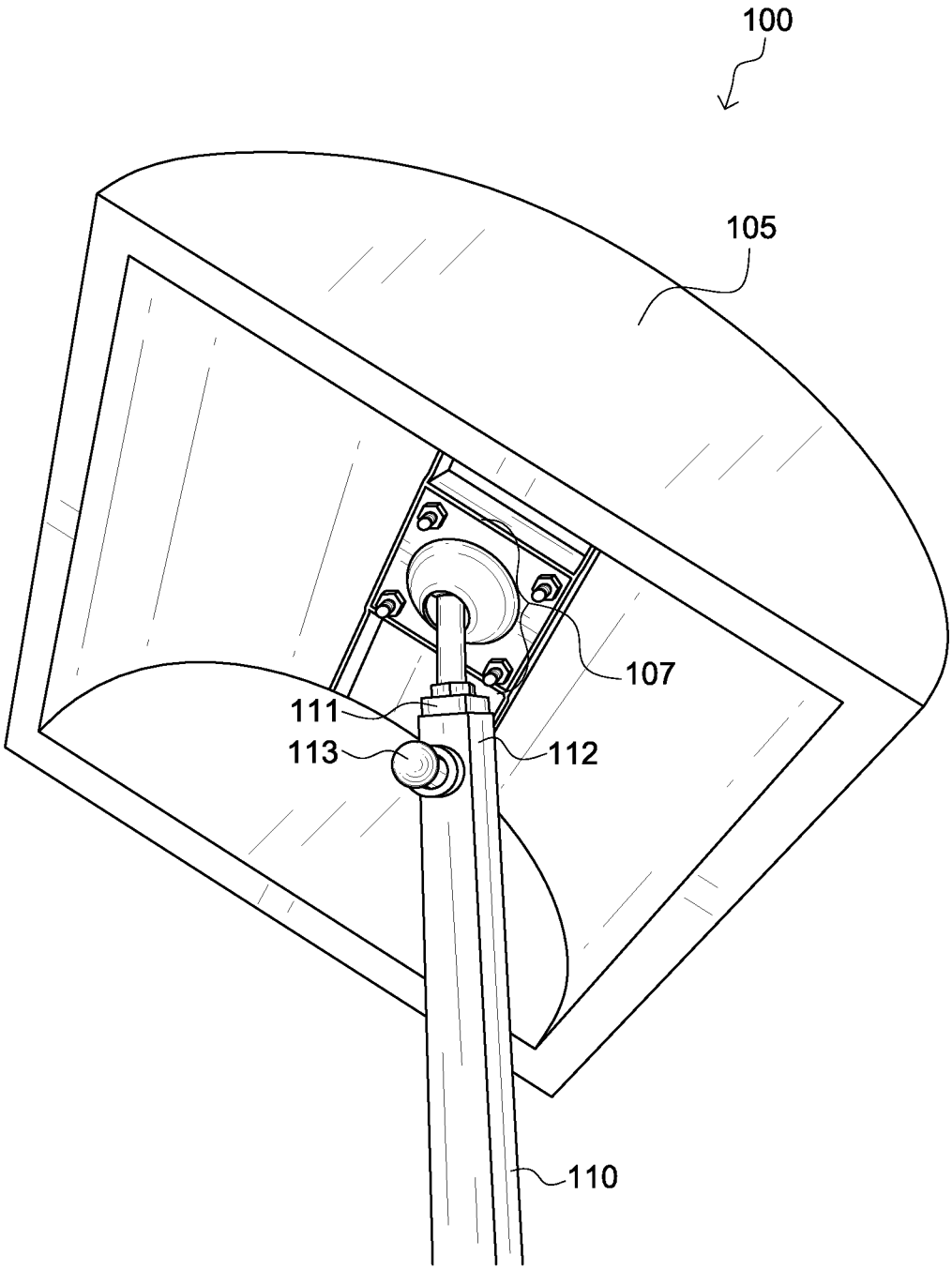
FIG. 2 is a perspective view of a seated balancing device according to one embodiment of the present invention.

A first embodiment seated balancing device 100 is illustrated in FIGS. 1 and 2. The first embodiment seated balancing device comprises a seat 105 coupled to borne by a universal joint 107 (not shown in FIG. 1, obscured by the seat), which is in turn coupled to and borne by a support member 110. The support member comprises a base structure 115, the base structure providing a relatively stable base for the seated balancing device.

The seat 105 of the first embodiment seated balancing device is a straddle seat and includes a seating surface 108. The seating surface is upwardly convex along a first axis 120, the first axis being a transverse or lateral axis. Variations of straddle seats include imitations of or actual horseback riding saddles. Seats that are not straddle seats are also contemplated.

In some embodiments, seated balancing devices are adapted to receive horseback riding saddles, which can be readily installed or removed therefrom. Accordingly, in some embodiments, a user can use the same riding saddle on her horse and on her seated balancing device.

The seat 105 is adapted to tilt about a pivot point, the pivot point residing within the universal joint 107. Accordingly, the seat is adapted to rotate about the first axis 120 and about a second axis 125. The first axis is perpendicular to the second axis, and both the first and second axes reside in the same plane. The second axis is a longitudinal axis. The pivot point resides where the first and second axes intersect. Rotation about the first axis can be referred to as pitch and rotation about the second axis can be referred to as roll. Rotation about any horizontal axis is referred to as tilt.

In FIG. 1, the seat 105 is illustrated in a neutral position. Both the first axis 120 and the second axis 125 are horizontal where the seat of the seated balancing device 100 resides in the neutral position. The seat is not self-righting, and therefore is not predisposed to attain or return to the neutral position. Where the seat of the seated balancing device is unoccupied and is not in its neutral position, the seat tends to tilt until it reaches a limit of its tilt range, due the action of gravity on the seat's center of mass.

The pivot point of the first embodiment seated balancing device 100 resides approximately 1¾ (1.75) inches from (beneath) the seating surface 108 at a closest point. This results in a relatively short, 1¾ (1.75) inch lever arm between the pivot point and the seating surface. In some embodiments, a pivot point resides up to 7 inches from a closest point of a seating surface. However, embodiments of the seated balancing device tend to perform better where the lever arm is shorter. Accordingly, the pivot point resides preferably 7 inches or less from the seating surface, more preferably 4 inches or less from the seating surface, and most preferably about 2 inches or less from the seating surface.

As best viewed in FIG. 2, the support member 110 comprises an inner shaft 111 residing within and being adapted to extend various lengths beyond an outer shaft 112 of the support member. This telescopic character of the support member enables height of the seating surface to be adjustable. A pin latch 113 is used to secure or release the inner shaft within the outer shaft in a manner familiar to persons skilled in the art. A pin of the pin latch extends through the outer shaft at one position and into the inner shaft at any of multiple positions. To adjust seating surface height, the pin is withdrawn from a first position of the inner shaft, a length of the inner shaft that extends beyond the outer shaft is changed, and the pin is inserted into a second position.

Figure 3:
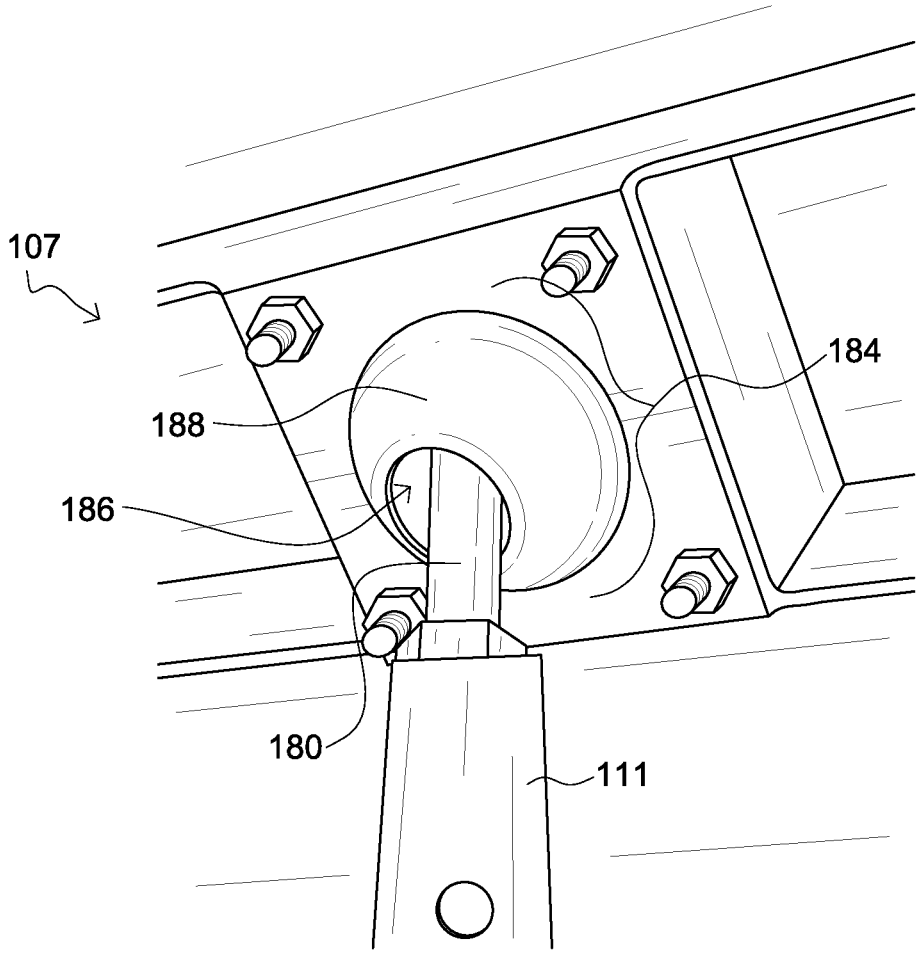
FIG. 3 is perspective view of a universal joint according to one embodiment of the present invention.
Figure 4:
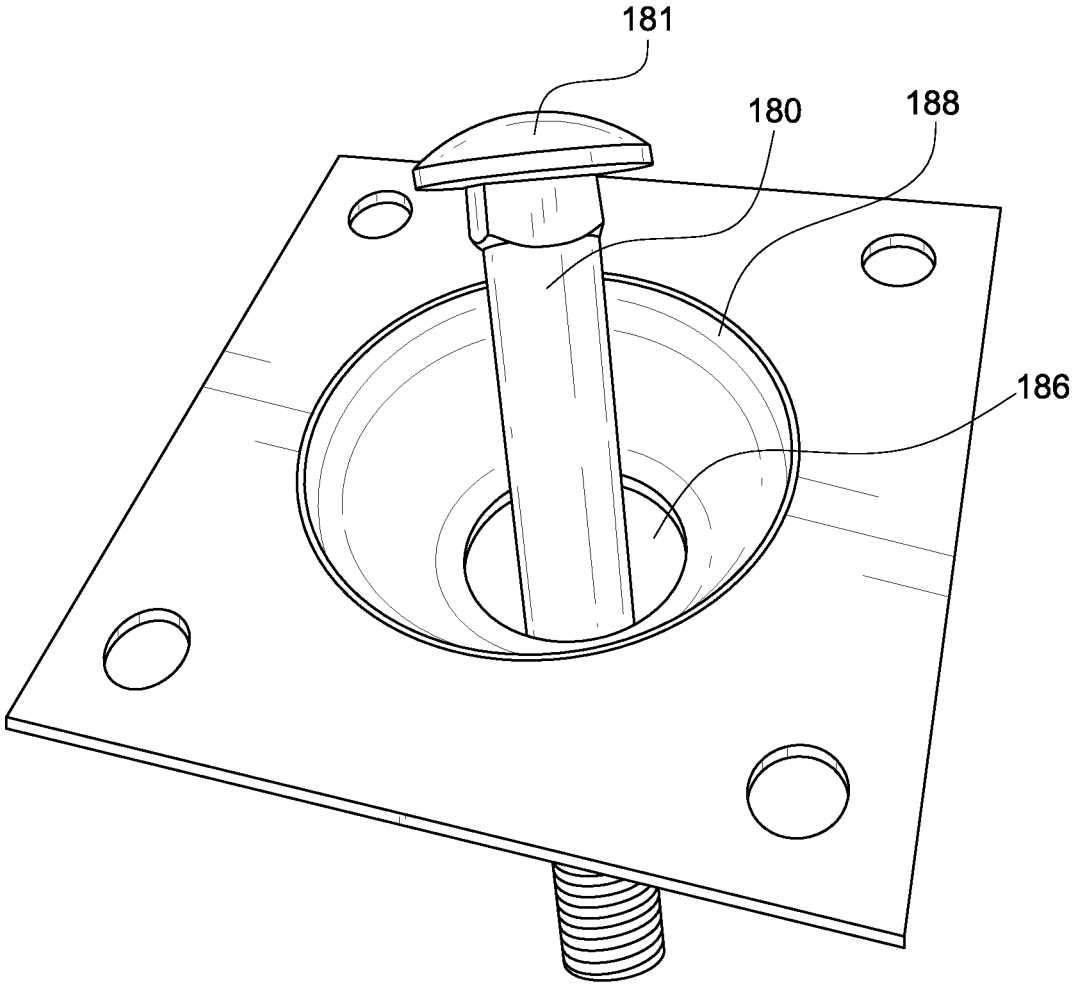
FIG. 4 is perspective view of parts of a universal joint according to one embodiment of the present invention

The universal joint 107 of the first embodiment seated balancing device is illustrated in FIG. 3, and a portion of the disassembled universal joint is illustrated in FIG. 4. The universal joint comprises a ⅝ (0.625) inch diameter carriage bolt 180 whose threaded end is secured to the inner shaft 111 of the support member. The carriage bolt extends into a socket 184 through an aperture 186, the socket comprising a lower hemisphere 188 and an upper hemisphere (obscured in FIG. 3 by the lower hemisphere and not included in FIG. 4). The aperture resides in the lower hemisphere. The socket interior is approximately spherical with a diameter of approximately 2⅜ (2.375) inch, and the aperture is approximately 1 inch in diameter. A domed head 181 of the carriage bolt (visible in FIG. 4 but obscured in FIG. 3) resides inside the socket interior, an interior surface of the socket interior in contact with and being supported by the domed head. Typically, the upper hemisphere rests on the domed head, a pivot point forming where the upper hemisphere contacts the domed head.

A first body of the universal joint 107 comprises the socket 184 and a second body of the universal joint comprises the carriage bolt 180. The socket is adapted to rotate about the first and second axes (shown in FIG. 1 but not in FIGS. 3 and 4), and thus has at least two degrees of rotational freedom relative to the carriage bolt 180. The seat 105 is solidly coupled to the socket and therefore shares the socket's rotational freedom. The pivot point of the first embodiment seated balancing device resides where the interior surface of the socket 184 contacts the domed head 181. The domed head 181 of the carriage bolt is larger than 1 inch and therefore will not pass through the aperture 186. Accordingly, the seat 105 can not be removed from the seated balancing device without disassembling the socket, and the seat is therefore prevented from falling off the seated balancing device.

The lower hemisphere 188 is illustrated in FIG. 4 with the ⅝ (0.625) inch diameter carriage bolt extending through the 1 inch aperture 186. The upper hemisphere is absent in FIG. 4, revealing the domed head 181 of the carriage bolt 180.

Tilt range can be adjusted by changing a relationship between carriage bolt 180 diameter and aperture 186 size. A user may typically begin training with a relatively large carriage bolt such as a ¾ (0.75) inch diameter carriage bolt and a 1 inch aperture. As the user's balance improves, the user may exchange a ⅝ (0.625) inch diameter carriage bolt for the ¾ inch diameter carriage bolt. The ⅝ inch bolt has a smaller dome head than the ¾ inch diameter carriage bolt, which results in reduced resistance to tilting. The ⅝ inch diameter carriage bolt also has a smaller shaft than the ¾ inch diameter carriage bolt, which results in greater tilt range. The greater tilt range of the ⅝ inch diameter carriage bolt compared to the ¾ inch diameter carriage bolt result in increased challenge to a user. Tilt range may be further increased by exchanging a lower hemisphere having a larger aperture (for instance, a 1⅛ (1.125) inch diameter aperture) in place of the lower hemisphere having a 1 inch aperture.

The seat of the first embodiment seated balancing device is adapted to tilt in any direction about 10.5° from a neutral position, and in an opposite direction about 10.5° from the neutral position. Thus a tilting range of the universal joint of the first embodiment seated balancing device is about 21°. Using a ¾ (0.75) inch diameter carriage bolt, the tilting range can be about 9°. The tilting range of the universal joint is readily adjusted to about 53° with a 1.5 inch aperture.

In some embodiments, resistance to tilting can be increased by placing a resilient collar around a carriage bolt. Variations include a resilient collar comprising polyurethane foam rubber and having an outside diameter of 1⅛ (1.125) inch and an inside diameter of ⅝ (0.625) inch. The resilient collar encircles a ⅝ (0.625) inch carriage bolt and compresses where it enters a 1 inch aperture of a socket. Further compression of the resilient collar provides resistance against tilting and also reduces tilt range, thus making the seated balancing device easier to balance on.

In some embodiments, a different style bolt or similar structure can be used in place of a carriage bolt. For instance, some variations of a universal joint employ a ⅝ inch diameter steel rod that is welded to a support member. The ⅝ inch diameter steel rod does not have a domed head. Rather, the steel rod tapers to a rounded end having a ⅛ (0.125) inch radius. Typically, an interior surface of a socket rests on the rounded end with a pivot point residing at an intersection of the rounded end and the interior surface of the socket.

A Second Embodiment Seated Balancing Device

Figure 5:
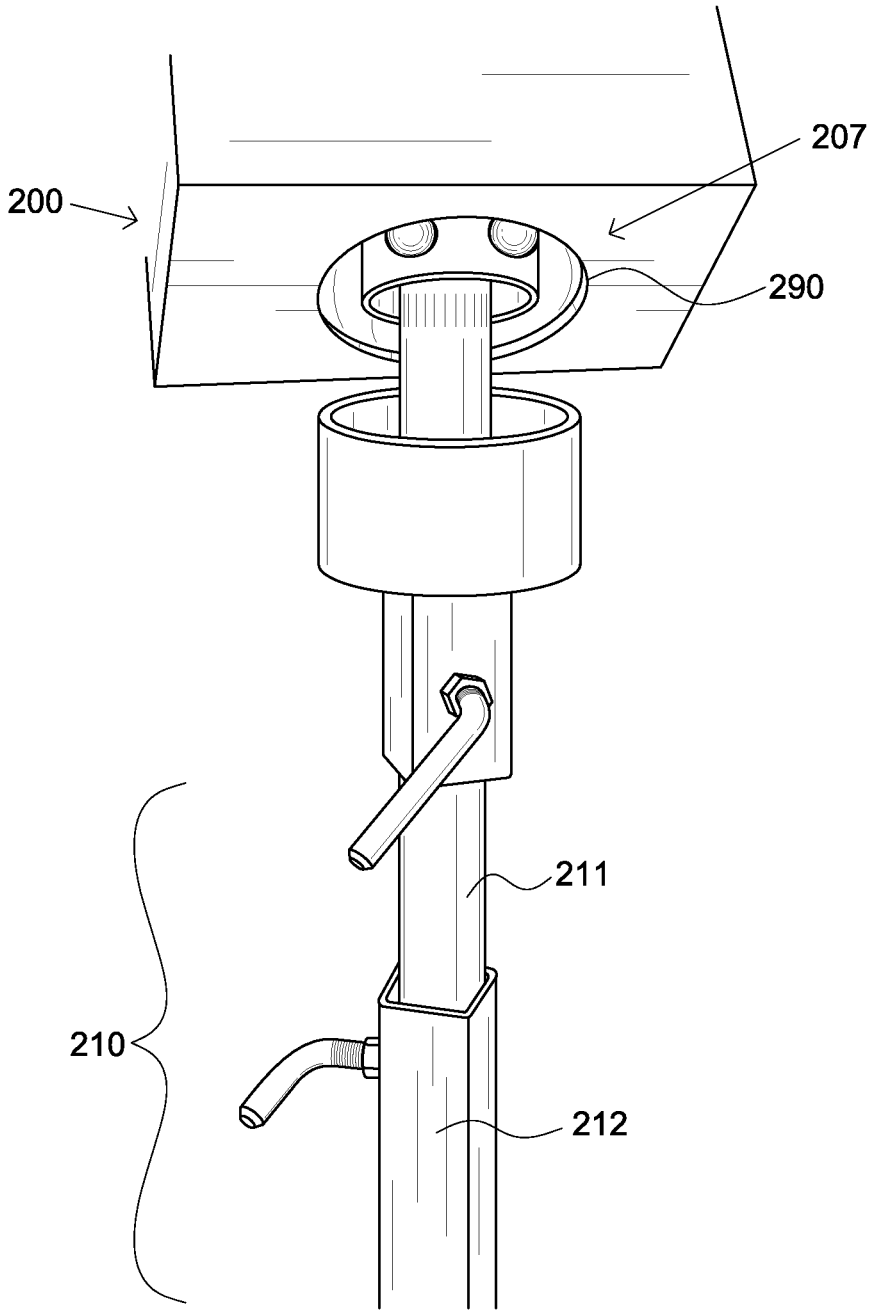
FIG. 5 is a perspective view of a seated balancing device according to one embodiment of the present invention.

A second embodiment seated balancing device 200 is illustrated in FIG. 5. A universal joint 207 of the second embodiment comprises an automotive universal joint from a light truck.

The universal joint includes a socket 290, a first body of the universal join comprising the socket. Accordingly, the socket has at least two degrees of rotational freedom. A seat (not shown) is solidly coupled to the socket 290 and therefore shares the socket's rotational freedom. Thus the seat is adapted to rotate about two horizontal axes, the two horizontal axis residing perpendicular to each other.

A tilt range of the second embodiment seated balancing device is at least 120°. A pivot point resides within the universal joint, about 3 inches below a seating surface of the second embodiment seated balancing device.

As with the first embodiment seated balancing device, the universal joint is coupled to an inner shaft 211 that extends from within an outer shaft 212, a telescopic support member 210 comprising the inner and outer shafts.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A seated balancing device comprising:

a support member;

a universal joint, the universal joint being borne by the support member;

a pivot point; and a seat, the seat including a seating surface, a portion of the seating surface residing less than seven inches from the pivot point, and the seat being (i) borne by the universal joint and (ii) adapted to tilt about the pivot point, wherein:

tilt about the pivot point is not powered; and the seat is not self-righting.

2. The seated balancing device of claim 1, wherein a height of the seating surface is adjustable.

3. The seated balancing device of claim 1, wherein the seat is a semi-cylindrical straddle seat.

4. The seated balancing device of claim 1, wherein a tilting range of the seat about a horizontal axis is at least 9°.

5. The seated balancing device of claim 4, wherein the universal joint has three rotational degrees of freedom.

6. The seated balancing device of claim 1, wherein a tilting range of the universal joint is adjustable.

7. The seated balancing device of claim 6, wherein the tilting range of the universal joint is adjustable in a range between about 9° and about 53°.

8. The seated balancing device of claim 1, wherein resistance to seat tilting is adjustable.

9. The seated balancing device of claim 1, wherein height of the portion of the seat surface is between 22 inches and 40 inches.

10. A method of using a seated balancing device comprising:

providing the seated balancing device of claim 1; and sitting upright on the seating surface, wherein the seating surface is upwardly convex across a transverse axis.

11. The method of claim 10, further comprising touching the ground with one or with one or more feet while sitting upright on the seating surface; and lifting the one or more feet from the ground while sitting upright on the seating surface.

12. The method of claim 11, wherein said sitting upright on the seating surface comprises straddling the seat.

13. The method of claim 12, wherein a portion of the seating surface resides less than four inches from the pivot point.

14. The method of claim 13, wherein a portion of the seating surface resides less than two inches from the pivot point.

15. A seated balancing device comprising:

a support member;

a universal joint, the universal joint being borne by the support member, including a pivot point, and having three degrees of rotational freedom; and a straddle seat, the straddle seat including a seating surface, a portion of the seating surface residing less than three inches from the pivot point, and the straddle seat being (i) borne by the universal joint, (ii) adapted to tilt in any direction about the pivot point, (iii) unpowered, and (iv) not self-righting.

16. A method of using the seated balancing device of claim 15 comprising sitting upright on the seating surface and balancing on the seating surface while not touching the ground with either foot.

* * * * *